US005190262A

United States Patent [19]

Woollatt

[11] Patent Number: 5,190,262

[45] Date of Patent: Mar. 2, 1993

[54] HYDRAULICALLY-OPERATED VALVE ASSEMBLY

[75] Inventor: Derek Woollatt, Campbell, N.Y.

[73] Assignee: Dresser-Rand Company, Corning, N.Y.

[21] Appl. No.: 803,871

[22] Filed: Dec. 9, 1991

[51] Int. Cl.[5] ..... F16K 31/163; F01L 9/02

[52] U.S. Cl. ..... 251/48; 251/63.4; 123/90.12

[58] Field of Search ..... 251/47, 48, 63.4; 123/90.12

[56] References Cited

U.S. PATENT DOCUMENTS 885,459 4/1908 Engler et al. ..... 123/90.12

1,020,685 3/1912 Cubelic ..... 251/48

1,427,111 8/1922 Knudsen ..... 251/48 X 2,827,884 3/1958 Stivender ..... 123/90.12

3,623,694 11/1971 Goldberg ..... 251/63.4 X 3,865,088 2/1975 Links ..... 123/90.12

4,312,494 1/1982 Aoyama ..... 251/48

*Primary Examiner*—John Rivell

*Attorney, Agent, or Firm*—Bernard J. Murphy

[57] ABSTRACT

A shank of the valve reciprocates within a hydraulic fluid-receiving chamber, and a cap, detachedly confined with the chamber cooperates with the shank to define a dashpot. The dashpot serves to decelerate the final closing of the valve to minimize wear of the valve head and the seat against which it closes.

9 Claims, 1 Drawing Sheet

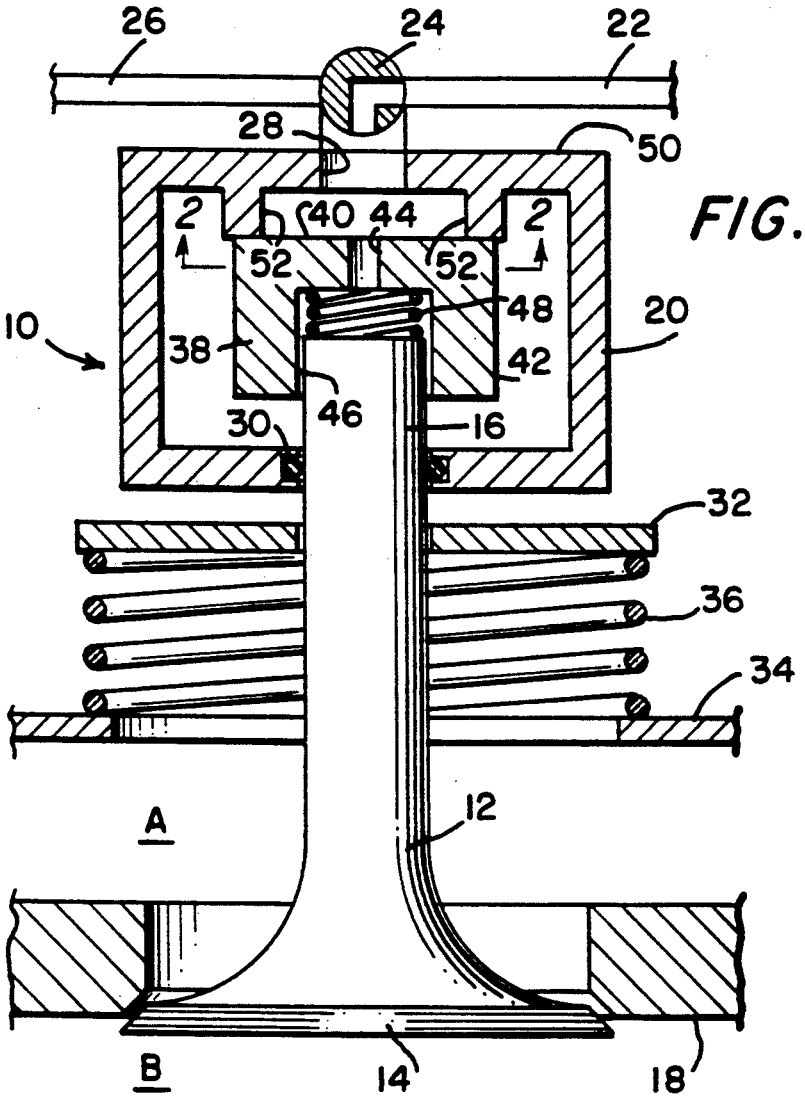
FIG. 1
FIG. 2
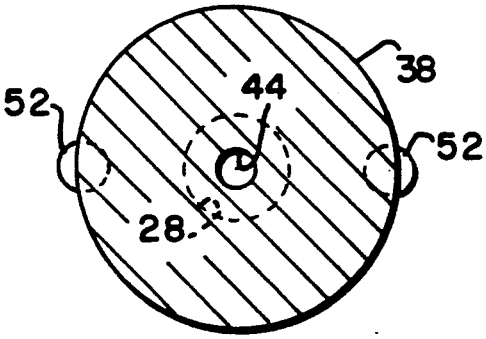
FIG. 3
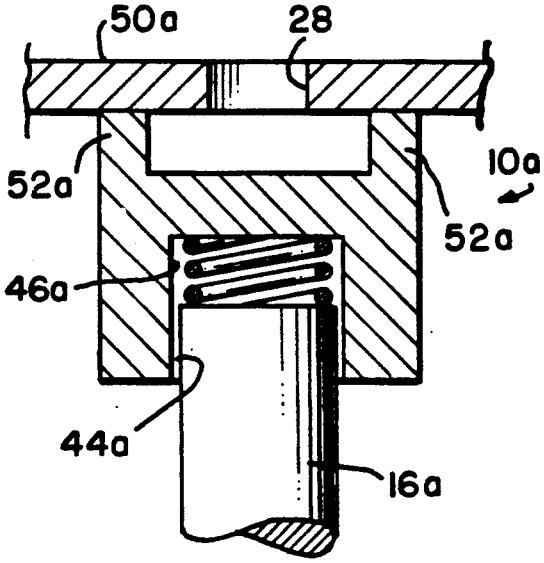

HYDRAULICALLY-OPERATED VALVE ASSEMBLY

This invention pertains to valves having heads for seating against valve seats, and in particular to such valves in valve assemblies which incorporate valve-closing damping means.

The wear rates of valves and valve seats are increased if the seating impact velocity is high. Yet, it is necessary for good flow performance that most of the valve travel towards its seat be at a high velocity. What is required is to reduce the velocity rapidly just as the valve head closes onto its seat. The latter is accomplished in cam-operated valves by using valve lifters, but such will not serve to dampen the closing velocity of other types of valve assemblies such as hydraulically-operated valve assemblies. Now, hydraulic dampeners can be used on all valve assemblies to cushion valve closing, but these have to be set manually and be adjusted frequently, because the several components thereof wear. What has long been needed is a self-adjusting, hydraulically-operated valve assembly, i.e., such a valve assembly in which the dampening thereof is self-adjusting and, as a consequence, requires minimal maintenance.

It is an object of this invention, then, to set forth a novel, hydraulically-operated valve assembly which has a self-adjusting dampening feature.

Particularly, it is an object of this invention to disclose a hydraulically-operated valve assembly comprising a valve seat; a chamber for receiving hydraulic fluid therewithin; a valve having a head for seating against, said removal from said seat, and having a shank for a reciprocation within said chamber; first means for admitting and discharging hydraulic fluid into and from said chamber; and second means interposed between said shank and said first means for hydraulically controlling movement of said shank within said chamber in at least one reciprocal direction.

Further objects of this invention, as well as the novel features thereof, will become more apparent by reference to the following description, taken in conjunction with the accompanying figures, in which:

FIG. 1 is a axial cross-sectional view of the novel valve assembly, according to an embodiment thereof, the same showing the hydraulic inlet and discharge only schematically;

FIG. 2 is a cross-sectional illustration taken along section 2—2 of FIG. 1; and

FIG. 3 is a fragmentary depiction of an alternate embodiment of the novel valve assembly, the same also being an axial cross-sectional view.

As shown in FIG. 1, the novel, hydraulically-operated valve assembly 10 comprises a valve 12 having a head 14 and a shank 16. The head 12 seats against, and removes from a valve seat 18, and the shank 16 is reciprocal within a chamber 20. Chamber 20 is disposed to receive hydraulic fluid from a supply line 22 via a rotary valve 24, and to vent such fluid therefrom, again via valve 24, through a line 26. The fluid enters and discharges from the chamber 20 through a port 28. An O-ring seal 30, interposed between the shank 16 and the chamber 20, prohibits leakage of fluid from the chamber 20. Intermediate the length of the shank, and fixed thereto, is a disc 32. Disc 32, and a land 34, have a compression spring 36 biased therebetween to urge the valve head 14 into closure onto the seat 18.

The assembly 10 is provided to control fluid flow between zones "A" and "B", as is conventional, and is not material to the disclosure of the invention.

Within the chamber 20, and detachedly confined therewithin, is a cap 38. Cap 38 has a base 40 and a circumferential wall 42 which extends from the base 40. Too, the cap 38 has a metering passage 44 formed therein which opens onto the chamber 20 and the bore 46 which the wall 42 defines. Shank 16 effects a substantially sealing interface with the wall 42. A compression spring 48 is interposed between the end of the shank 16 and the base 40 to urge the cap 38 and shank 16 apart. The chamber 20 has a top 50 from which extend stand-offs 52, the same being provided to delimit the upward (as viewed in FIG. 1) travel of the cap 38 in the chamber 20.

With low pressure in the chamber 20, the valve head 14 is closed against the seat 18, and the spring 48 holds the cap 38 against the stand-offs 52. Upon the rotary valve 24 admitting hydraulic fluid into the chamber 20, from line 22, valve 12 is opened, against the bias of the spring 36; head 14 removes from seat 18. Too, cap 38 is moved away from the stand-offs 52.

While high-pressure hydraulic fluid is maintained in the chamber 20, the spring 48 proceeds to move the cap 38 away from the end of the shank 16, and this displacement draws hydraulic fluid through the passage 44 and into the bore 46.

Upon the rotary valve 24 being rotated, to discharge the hydraulic fluid from chamber 20, valve 12 will commence to close, in response to the urging of spring 36. Prior to the head 14 impacting the seat 18, the cap 38, which had occupied a disposition between the end of the shank 16 and the stand-offs 52, will impact the stand-offs. Now, the valve 12 is decelerated in its final travel toward closure, because the shank 16 and cap 38 cooperatively define a dashpot. The hydraulic fluid which had been drawn into the bore 46 can only slowly exit through the metering passage 44.

With wear of the head 14 and/or the seat 18, no adjustment of the valve assembly is necessary as, self-evidently, the assembly is self-adjusting for such wear. The valve 12 can be opened rapidly, and its closure can commence rapidly as well, but its final travel will be dampened; the head will settle gently against the seat 18. Consequently, wear will be greatly minimized, while there occurs no loss of flow performance.

As explained, the passage 44 is provided to meter the discharge of hydraulic fluid from the bore 46. In an alternative embodiment of the valve assembly **10*a*, passage 44 can be supplanted by a defining a controlled clearance between the shank 16 and the bore 46**. Such is shown in FIG. 3.

Shank **16*a*, in FIG. 3, defines a given-clearance interface with the bore 36*a*, to form an annular, metering passage 44*a* therebetween. Also, as shown in assembly 10*a*, the stand-offs 52*a* can be integral with the cap 38*a*, rather than having them depend from the top 50*a* of the chamber 20**.

While I have described by invention in connection with specific embodiments thereof it is to be clearly understood that this is done only by way of example, and not as a limitation to the scope of the invention as set forth in the objects thereof and in the appended claims.

I claim:

1. A hydraulically-operated valve assembly, comprising:

a valve seat;

a chamber for receiving hydraulic fluid therewithin;

a valve having a head for seating against, and removal from said seat, and having a shank for reciprocation within said chamber;

first means for admitting and discharging hydraulic fluid into and from said chamber; and second means interposed between said shank and said first means for hydraulically controlling movement of said shank within said chamber in at least one reciprocal direction; wherein said second means comprises a cap having a cylindrical bore; and said shank defines a substantially sealing interface with said bore.

2. A hydraulically-operated valve assembly, according to claim 1, wherein:

said second means and said shank cooperatively define a dashppot.

3. A hydraulically-operated valve assembly, according to claim 1, wherein:

said cap is detachedly confined within said chamber, and effects a slidable engagement with said shank.

4. A hydraulically-operated valve assembly, according to claim 3, further including:

means interposed between said chamber and said cap for delimiting movement of said cap within said chamber.

5. A hydraulically-operated valve assembly, according to claim 4, wherein:

said movement delimiting means comprises stand-offs extending from said chamber inwardly toward said cap.

6. A hydraulically-operated valve assembly, according to claim 1, further including:

means interposed between said shank and said cap for urging said cap away from said shank.

7. A hydraulically-operated valve assembly, comprising:

a valve seat;

a chamber for receiving hydraulic fluid therewithin;

a valve having a head for seating against, said removal from said seat, and having a shank for reciprocation within said chamber;

first means for admitting and discharging hydraulic fluid into and from said chamber; and second means interposed between said shank and said first means for hydraulically controlling movement of said shank within said chamber in at least one reciprocal direction; wherein said second means comprises a cap having (a) a base, and (b) a circumferential wall extending from said base defining a bore therewithin; and said cap has a metering passage formed therein which opens onto said bore and onto said chamber.

8. A hydraulically-operated valve assembly, according to claim 7, wherein:

said passage is formed in said base.

9. A hydraulically-operated valve assembly, comprising:

a valve seat;

a chamber for receiving hydraulic fluid therewithin;

a valve having a head for seating against, and removal from said seat, and having a shank for reciprocation within said chamber;

first means for admitting and discharging hydraulic fluid into and from said chamber; and second means interposed between said shank and said first means for hydraulically controlling movement of said shank within said chamber in at least one reciprocal direction; wherein said second means comprises a cap having a cylindrical bore; and said shank defines a given-clearance interface with said bore, forming, with said bore, an annular metering passage.

* * * * *